US005346003A

United States Patent [19]

Halstead et al.

[11] Patent Number: 5,346,003

[45] Date of Patent: Sep. 13, 1994

[54] FACE PLUMBED CONDENSER FOR AUTOMOTIVE AIR CONDITIONER

[75] Inventors: Gary A. Halstead; Gregory R. Smith, both of Lockport, N.Y.

[73] Assignee: General Motors Corporation, Detroit, Mich.

[21] Appl. No.: 134,455

[22] Filed: Oct. 12, 1993

[51] Int. Cl.[5] ..... F28F 9/02

[52] U.S. Cl. ..... 165/173; 165/178

[58] Field of Search ..... 165/153, 173, 178

[56] References Cited

U.S. PATENT DOCUMENTS

| | | | |
|---|---|---|---|
| 4,623,017 | 11/1986 | Oda et al. | 165/173 X |
| 4,938,284 | 7/1990 | Howells | 165/149 |
| 5,009,262 | 4/1991 | Halstead et al. | 165/140 |
| 5,062,476 | 11/1991 | Ryan et al. | 165/173 |
| 5,094,293 | 3/1992 | Shimmura | 165/173 X |
| 5,127,466 | 7/1992 | Ando | 165/67 |
| 5,240,068 | 8/1993 | Tohatube | 165/173 X |

FOREIGN PATENT DOCUMENTS 3720483 1/1988 Fed. Rep. of Germany ..... 165/173

*Primary Examiner*—John C. Fox

*Attorney, Agent, or Firm*—Patrick M. Griffin

[57] ABSTRACT

A headered tube and type condenser for automotive applications has a pair of tanks with side walls that face the ends of the tubes, and flat face walls perpendicular thereto. After installation, the tank face walls face the vehicle radiator. The ends of the tubes extend partially into the tanks, and have a predetermined spacing from the side walls of the tank, A fitting, either inlet our outlet or both, is secured to the face wall of either or both tanks. The portion of the fitting that extends into the tank has a smaller width than the predetermined spacing, and so can be placed anywhere along the entire length of the face wall without hitting the ends of the tubes.

3 Claims, 2 Drawing Sheets

FACE PLUMBED CONDENSER FOR AUTOMOTIVE AIR CONDITIONER

This invention relates to vehicle air conditioning system condensers in general, and specifically to a new design for a headered tank and tube type of condenser that allows for more compact packaging and more flexible plumbing.

BACKGROUND OF THE INVENTION

An automotive air conditioning condenser finding increased usage is the so-called headered tank and tube condenser, a good example of which is shown in co-assigned U.S. Pat. No. 5,062,476. Each of a pair of tank units has a three-sided channel or extrusion closed on the fourth side by a slotted plate or header that is clinched and brazed in place to form a basically rectangular cross section, although the header may be slightly arcuate. Relatively short lengths of extruded tubing run between the tanks, through the slotted headers. Another style of such a condenser uses tanks that are cylindrical or almost cylindrical, and, in some designs, the tanks are actually comprised of sections of seamless cylindrical pipe, with no separate header plate. Condensers, of whatever design, are typically mounted in front of the vehicle radiator, just behind the grill, so that the same fan can force cooling air over both heat exchangers simultaneously. With increasingly scarce underhood space, it is desirable to save underhood space wherever possible. One proposal is to combine the two heat exchangers into one modular unit, as illustrated in U.S. Pat. No. 5,009,262, assigned to the assignee of the subject invention. Even such a combined unit, however, cannot share the heat exchanging media, which must be kept hydraulically discrete, or share plumbing or line connections into or out of the respective tanks.

Prior art condensers of the type described above sometimes place the line fittings, and inlet and outlet fitting, on the top end of the respective inlet and outlet tanks, which creates an obvious limitation on line routing. Often, the fittings extend through the side wall of the tank, that is, through that wall or part of the tank that directly faces the ends of the tubes within the tanks. This is a more flexible arrangement in that it does not confine the fitting just to the end or top of the tank, but it also puts the fitting directly in line with the ends of the tubes within the inlet tank. If over inserted, the fitting can hit the tube ends, and even if properly inserted, the hot refrigerant rushing through the inlet fitting directly impinges on the ends of the tubes to which it is closest. More important, there are applications where it would be desirable to place the fittings on the face of the tank instead, that is, on that wall or portion of the tank that is perpendicular to the side of the tank, and which directly faces the radiator behind the condenser. This may, in some situations, allow for more compact and direct line routing. Often, in such designs, there is not sufficient room between the tube ends and the tank side wall that they directly face to allow a fitting to be inserted through the face wall of the tank, perpendicular to the tube ends, without hitting the tube ends. The obvious solution of making the fitting small enough in diameter to slide between the tube ends would require that the fitting be precisely located on the face wall, or it would hit the tube ends regardless, and a diameter that small might well be too small to handle the necessary refrigerant flow.

SUMMARY OF THE INVENTION

The invention provides a design for a face plumbed tank and tube condenser in which the fitting can be located easily along the face wall of the tank. In the embodiment disclosed, the tank unit is comprised of a header plate and an extrusion that provides three basically flat walls, a side wall facing the header plate and two face walls perpendicular thereto, one of which will be opposed to the radiator when the condenser is installed to the vehicle. The interior surfaces of the face walls are formed with a pair of parallel, continuous ridges which, when the tubes are installed through the header plate, stop and hold the ends of the tubes a predetermined distance away from the side wall of the tank unit.

A fitting, either inlet or outlet, has a stepped cylindrical shape, with a reduced diameter, cylindrical lead portion or sleeve that is smaller than the predetermined distance defined above. At any desired point along the face wall of the tank unit, a fitting bore is drilled into the tank, sized so as to make a snug press fit with the fitting's sleeve. The fitting can then be relatively easily installed by pressing the sleeve into the bore, clear of the tube ends, until a shoulder on the fitting abuts the face wall. When the entire condenser is brazed together, the fitting is finally secured to the tank unit. Since it faces toward the radiator, after installation, no part of the fitting, nor of the line ultimately attached to it, extends beyond the side wall of the tank unit, giving a compact package.

DESCRIPTION OF THE PREFERRED EMBODIMENT

These and other features of the invention will appear from the following written description, and from the drawings, in which.

Figure 1:
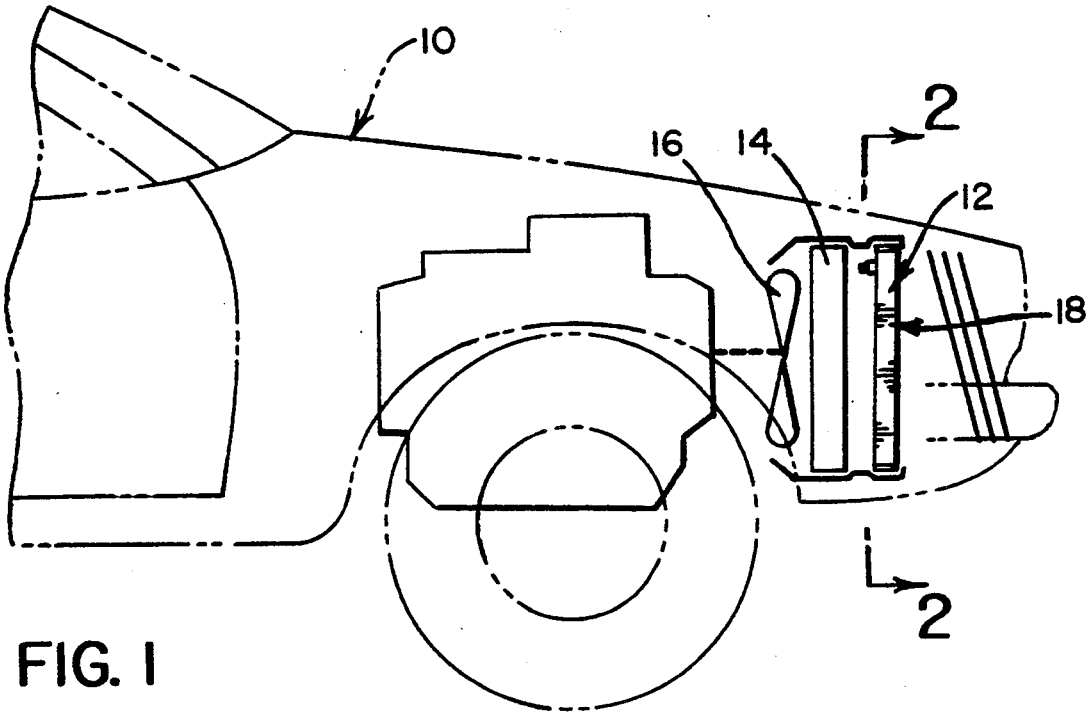
FIG. 1 is a schematic view of a vehicle showing the condenser of the invention installed.
Figure 2:
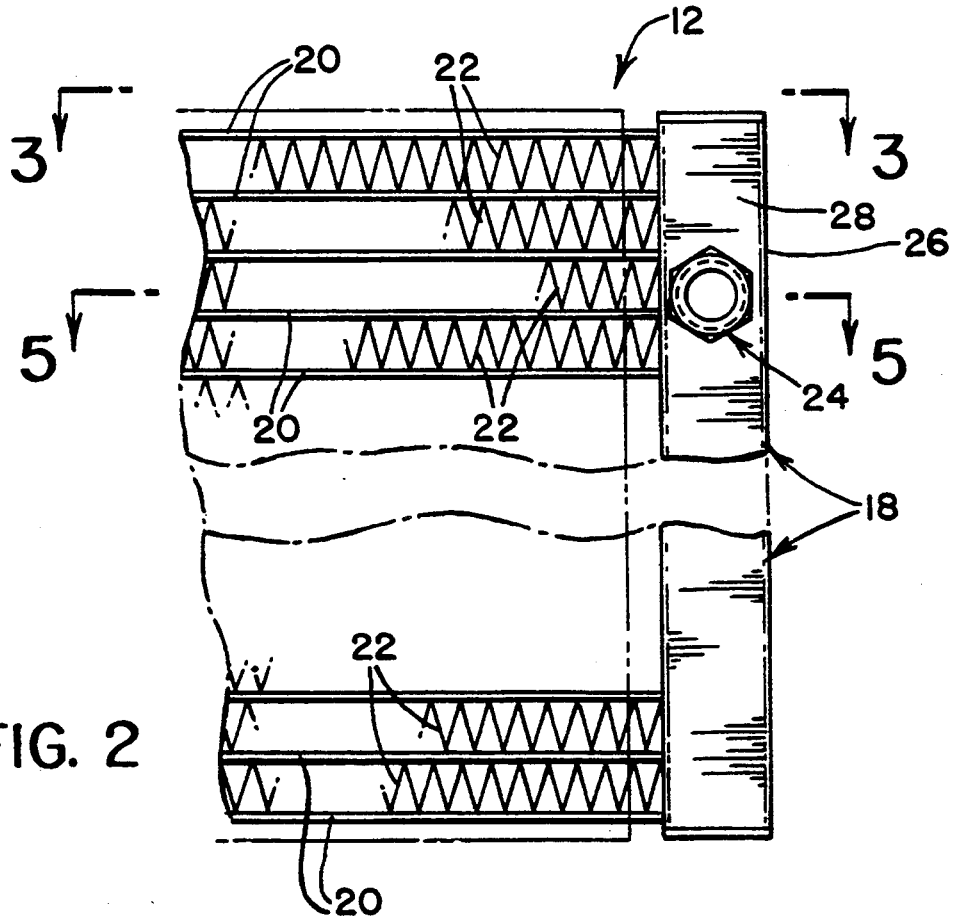
FIG. 2 is a view taken along the line 2—2 of FIG. 1.

Referring first to FIGS. 1 and 2, a vehicle (10) includes an air conditioning system that in turn includes a condenser incorporating the invention, indicated generally at (12). A radiator (14), mounted parallel to and behind condenser (12), is cooled by forced air from fan (16) simultaneously with radiator (14). Condenser (12) is the headered, tank and tube type, with a pair of identical vertically mounted tank units, one of which is indicated at (18). A plurality of extruded parallel tubes (20) run horizontally between the tank units (18), between each pair of which a cooling fin (22) is brazed. A fitting, indicated generally at (24), is secured to tank unit (18) according to the invention, as is described next.

Referring next to FIG. 2, tank unit (18) is comprised of an aluminum extrusion that provides three of its four sides, including a flat side wall (26) and a pair of parallel, flat face walls (28) perpendicular thereto and generally parallel to the tubes (20). On the inner surface of the face walls (28) are a pair of continuously extruded ledges or ridges (30). The fourth side of tank unit (18) is formed by a separate header plate (32), which is crimped to the outer edges of the face walls (28) and slotted along its length to receive the ends of the tubes (20). When the tubes (20) are installed through the header plate (32), the ends thereof abut and are stopped by the ridges (30) so as to space them a minimum predetermined distance X away from the side wall (26), which they directly face. A cylindrical bore (34) is machined through one of the face walls (28), the one that will eventually face the radiator (14), and has a diameter D that is less than X.

Figure 3:
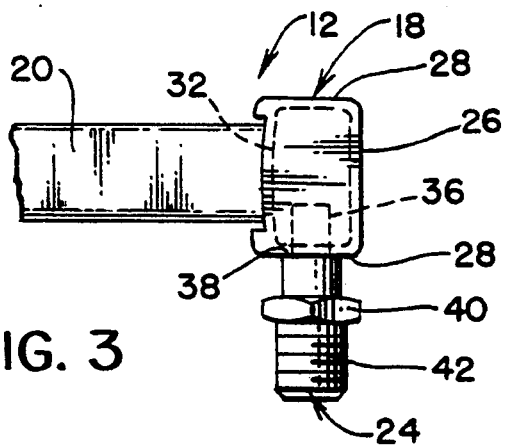
FIG. 3 is a view taken along the line 3—3 of FIG. 2.
Figure 4:
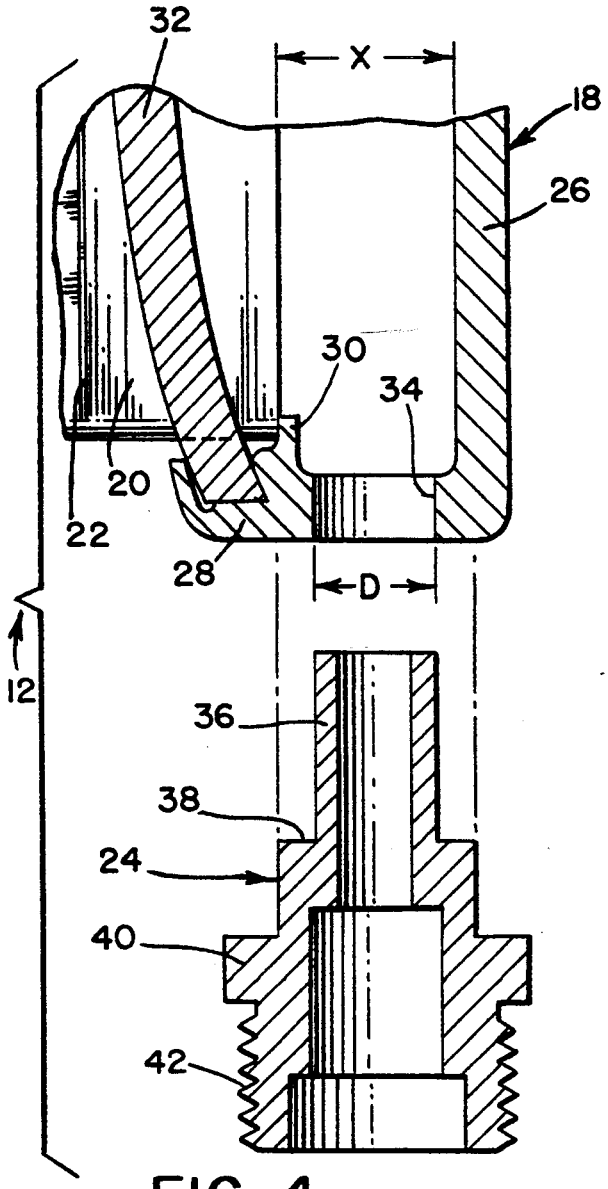
FIG. 4 is a cross sectional view like FIG. 5, but showing the fitting disassembled.
Figure 5:
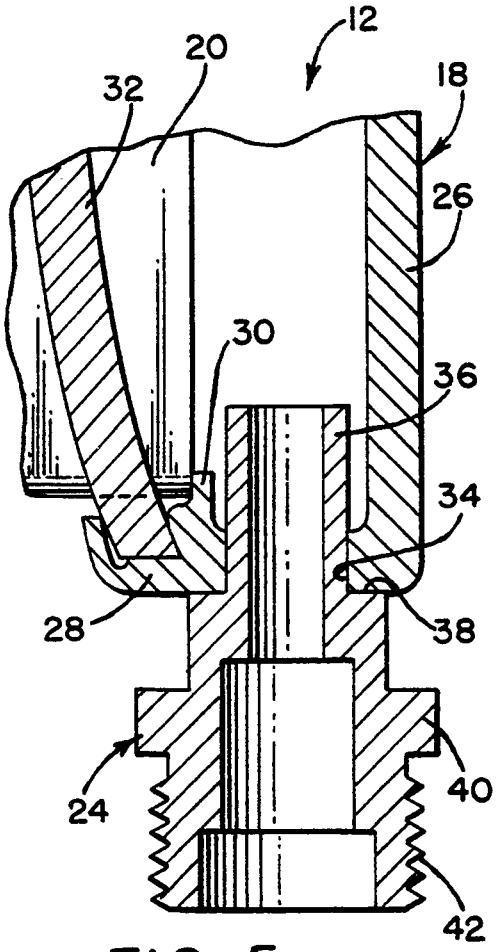
FIG. 5 is a cross sectional view through the assembled fitting taken along the line 5—5 of FIG. 2.

Referring next to FIGS. 3 through 5, details of fitting (24) are described. Fitting (24) is a machined aluminum piece with a generally stepped cylindrical shape, including a smaller diameter cylindrical sleeve (36) and a larger diameter shoulder (38) at the front. A hex flange (40) and threaded barrel (42) at the front complete fitting (24). The width or diameter of sleeve (36) is sufficient to make a snug press fit into bore (34), that is, a fit not so tight as to prevent insertion or hand turning, but tight enough to prevent slippage after insertion. This allows sleeve (36) to be pushed into bore (34) as shown in FIG. 5, until shoulder (38) abuts face wall (28), generally perpendicular to face wall (28) and, therefore, to the tubes (20), as well. Sleeve (36) is clear of the ends of tubes (20) and, once inserted, fitting (24) can be twisted so as to put the flats on hex flange (40) in any desired orientation. This is important, as the hex flange (40) is used to apply a back up wrench to support the fitting (24) when a line is threaded onto (42), so as to prevent stress on fitting (24) at its juncture with face wall (28). There may well be a preferred orientation for the wrench that can be assured by so orienting the fitting (24). Once installed, fitting (24) is completely and accurately positioned relative to tank unit (18), axially and radially, and will not move with regular handling. This allows condenser (12) to be loaded into a braze furnace without concern as to shifting or disturbing fitting (24). If desired, a ring of braze material may be placed around shoulder (38) so as to form a joint at the interface with the outer surface of face wall (28) during the brazing process. In the completed condenser (12), sleeve (36) can be any length that will clear the opposite face wall (28), but is still assured of noncontact with the ends of the tubes (20). In the case where fitting (24) is the inlet fitting (it can be either or both fittings), there is no direct impact of hot refrigerant on the ends of tubes (20). The relatively large area of surface contact between the various elements of fitting (24) and face wall (28) give a robust connection. This is a feature made possible by the fact that the fitting (24) is plumbed through the face wall (28), and not through the side wall (26). The face wall (28) can be made relatively thick without taking a lot of interior volume out of tank unit (18). Not so with the longer side wall (26). Thus, the bore (34) can be made axially thick or deep to give high surface area contact with the outer surface of sleeve (36).

Variations of the preferred embodiment disclosed are possible. A less complexly shaped fitting than (24) could be used, even one that was a simple, straight section of pipe or tube. Without the shoulder (38), of course, it would not provide the axial location feature, or create as robust a securement to the face wall (28). It would still clear the ends of the tubes (20), and could still be applied wherever desired along the length of the face wall (28). Therefore, it will be understood that it is not intended to limit the invention to just the embodiment disclosed.

We claim:

1. A heat exchanger for an automotive air conditioning system, comprising, a pair of parallel tanks at least of one which has a substantially flat face wall and a side wall portion, a plurality of tubes extending into and between said tanks generally parallel to said face wall, the ends of which face said tank side wall portion with a predetermined spacing therebetween, and, a fitting secured to and through said face wall generally perpendicular thereto and having a width less than said predetermined distance so that said fitting extends into said tank clear of said tube ends.

2. In a heat exchanger for an automotive air conditioning system of the type having a pair of parallel tanks and a plurality of tubes extending into and between said tanks with a predetermined distance between said tube ends and a side wall portion of said tanks, and in which at least one of said tanks has a side wall substantially flat face wall that is generally parallel to said tubes, the improvement comprising, a fitting secured to and through said face wall generally perpendicular thereto and having a width less than said predetermined distance so that said fitting extends into said tank clear of said tube ends.

3. In a heat exchanger for an automotive air conditioning system of the type having a pair of parallel tanks and a plurality of tubes extending into and between said tanks with a predetermined distance between said tube ends and a side wall portion of said tanks, and in which at least one of said tanks has a side wall substantially flat face wall that is generally parallel to said tubes, the improvement comprising, a cylindrical bore in said face wall in said face wall having a diameter less than said predetermined distance, and a fitting having a cylindrical sleeve sized to make a snug fit into said bore and a larger diameter shoulder, whereby said fitting may be secured to said face wall clear of said tube ends by inserting said sleeve into said bore until said shoulder abuts said face wall.

* * * * *